US007972158B2

(12) United States Patent
Wild et al.

(10) Patent No.: US 7,972,158 B2
(45) Date of Patent: Jul. 5, 2011

(54) CO-AXIAL PUSH-PULL PLUG-IN CONNECTOR

(75) Inventors: Werner Wild, Buttenwiesen (DE); Rudolf Peschka, Frasdorf (DE)

(73) Assignee: Rosenberger Hochfrequenztechnik, GmbH & Co. KG, Firdolfing (DE)

( * ) Notice: Subject to any disclaimer, the term of this patent is extended or adjusted under 35 U.S.C. 154(b) by 387 days.

(21) Appl. No.: 12/095,620

(22) PCT Filed: Nov. 30, 2006

(86) PCT No.: PCT/EP2006/011512

§ 371 (c)(1),
(2), (4) Date: May 30, 2008

(87) PCT Pub. No.: WO2007/062845

PCT Pub. Date: Jun. 7, 2007

(65) Prior Publication Data

US 2010/0233901 A1 Sep. 16, 2010

(30) Foreign Application Priority Data

Dec. 1, 2005 (DE) ..... 10 2005 057 444

(51) Int. Cl.
*H01R 4/38* (2006.01)

(52) U.S. Cl. ..... 439/257; 439/578; 439/352

(58) Field of Classification Search ..... 439/253–257, 439/578, 352
See application file for complete search history.

(56) References Cited

U.S. PATENT DOCUMENTS

| | | | | |
|---|---|---|---|---|
| 5,802,710 | A * | 9/1998 | Bufanda et al. | 29/828 |
| 6,153,830 | A | 11/2000 | Montena | |
| 6,267,612 | B1 * | 7/2001 | Arcykiewicz et al. | 439/253 |
| 6,692,285 | B2 * | 2/2004 | Islam | 439/352 |
| 6,769,926 | B1 | 8/2004 | Montena | |
| 2003/0178845 | A1 | 9/2003 | Islam | |
| 2004/0014350 | A1 | 1/2004 | McMullen et al. | |

FOREIGN PATENT DOCUMENTS

EP 1222717 B1 5/2003

* cited by examiner

*Primary Examiner* — Ross N Gushi
(74) *Attorney, Agent, or Firm* — DeLio & Peterson, LLC; Robert Curcio

(57) ABSTRACT

An RF plug connector having a plug head on which a sliding sleeve is seated which can be rotated, can be moved axially and clasps a radially elastic collet (4) in such a manner that the sliding sleeve compresses the collet radially in the coupled state, the design can be considerably simplified in comparison to that of known plug connectors of this generic type, to be precise by the collet (4) being arranged such that it cannot be moved axially on the plug head. For connection to a coupler with an external thread, the collet (4) has internal profiling on the plug side, in particular an internal thread with a pitch which is not the same as that of the external thread of the coupler.

3 Claims, 2 Drawing Sheets

CO-AXIAL PUSH-PULL PLUG-IN CONNECTOR

The invention relates to a co-axial push-pull plug-in connector having a male head on which is mounted an axially displaceable sliding sleeve which fits over a collet, which latter is radially elastic and is non-displaceably mounted on the male head, in such a way that, when the plug-in connector is in the coupled state, the sliding sleeve compresses the collet of the plug-in connector radially.

A plug-in connector of the generic kind specified above is known from DE C 32 00 265. For coupling purposes, a sliding sleeve is advanced towards a coupler complementary to the connector, thus causing the ends of the collet, which are thickened on the mating side, to engage in an annular groove in the sliding sleeve. Once coupling has taken place, the collet automatically returns to its starting position, which forms the locking position. For uncoupling purposes, the sliding sleeve is drawn back even further, thus enabling the ends of the collet to spring apart into a further annular groove in the sliding sleeve. So that the sliding sleeve will automatically return to its central starting position both from the advanced position and from the drawn-back position, the sliding sleeve is preloaded radially towards a V-shaped groove in the circumferential surface of the male head. A plug-in connector of this kind is expensive to produce and complicated to manipulate.

Another co-axial push-pull plug-in connector is known from DE C 44 39 852. To make a connection to a coupler belonging to the same system, a sliding sleeve is slid towards the coupler. When this is done, it first entrains a collet towards the coupler axially, in opposition to the force exerted by a coil spring. Then, the collet is compressed radially by the sliding sleeve. Mounted in the collet is a resilient ring which, in the coupled state, is held clamped to the outside thread on the coupler. The elastic restoring forces must be so adjusted that, in the course of the plugging-in process, the coil spring is first compressed axially and only then is the collet compressed radially. A disadvantage is the complicated coupling mechanism.

The object underlying the invention is to provide a plug-in connector which is of the generic kind specified in the opening paragraph but which is simpler in construction.

This object is achieved in accordance with the invention by a plug-in connector having the features specified in claim 1.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

Because the coupling mechanism of the plug-in connector is in only two parts, the plug-in connector can be produced inexpensively. Also, its overall size is appreciably shorter than that of the first plug-in connector mentioned above. In comparison with the second plug-in connector mentioned above, more secure and reliable contact is made with the coupler, because the collet surrounds the thread of the coupler directly, without any intervening elastic ring.

The plug-in connector is connected to the RF-coupler in such a way to be free of any play in the axial direction, because the collet has an inside thread which is of a different pitch from the outside thread on the coupler.

When the plug-in connection has been made, any loosening thereof as a result of the cable being rotated is reliably prevented because the sliding sleeve and the collet are mounted on the male head in such a way as to allow rotation.

The male head of the plug-in connector is so arranged as to receive the appropriately arranged end of a co-axial cable simply by its being pushed in and, for example, the outer conductor of the cable being soldered to the male head, which means that the centre conductor of the cable and the dielectric of the cable at the same time form the centre conductor of the connector and its dielectric.

The sliding sleeve preferably has, at its end adjacent the cable, an internal, and in particular annular, shoulder which, when the plug-in connector is in the coupled position, engages in a recess, which is in particular annular, in the circumferential surface of the male head, to enable a latching action to be achieved (claim 2).

The sliding sleeve is preferably slotted axially in the region of its internal shoulder at the end adjacent the cable and is thereby elastic radially (claim 3).

The manufacturing costs of a sliding sleeve made of plastics material are substantially better than those of a metal sleeve.

The invention is explained below by reference to the drawings. These show—merely as an illustrative embodiment and in a simplified schematic way—a plug-in connector and the (bulkhead) coupler which fits it, conforming to SMA standard IEC 60169-15.

Figure 1:
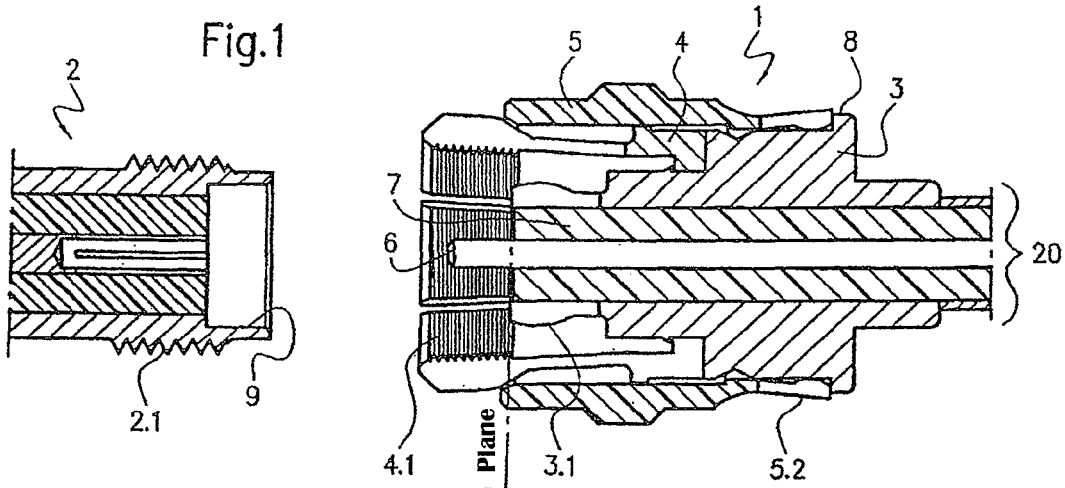
FIG. 1 depicts a connector of the present invention and a coupler.

FIG. 1 shows a connector 1 and a coupler 2. The connector comprises a male head 3, a collet 4 made of metal and a sliding sleeve 5 made of plastics material. The centre conductor and the dielectric of a suitably arranged standard co-axial cable 20 act as the centre conductor 6 of the connector and the dielectric 7 of the connector, while the outer conductor of the co-axial cable 20 is merely indicated and is electrically and mechanically connected to the male head 3 in any desired known manner. The sliding sleeve 5 has been slid back as far as a stop 8 at the end adjacent the cable. The resilient collet 4 is relaxed by this means, thus enabling the coupler 2 to be slid into the connector 1, as shown in FIG. 1*a*.

Figure 1A:
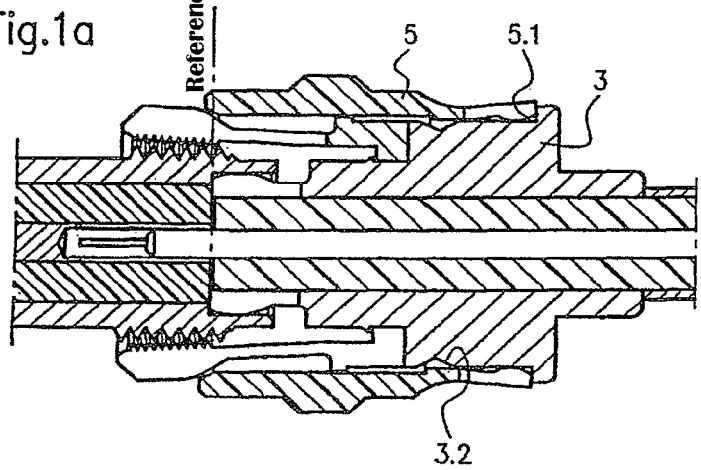
FIG. 1*a* depicts the coupler of the present invention slid into the connector of FIG. 1.

In FIG. 1*a*, the inserting end of the male head 3 engages in a recess 9 in the coupler 2. A rounded thickening 3.1 of the slotted inserting end of the male head 3 allows the outer connector to make secure and reliable contact with the coupler 2.

Figure 1B:
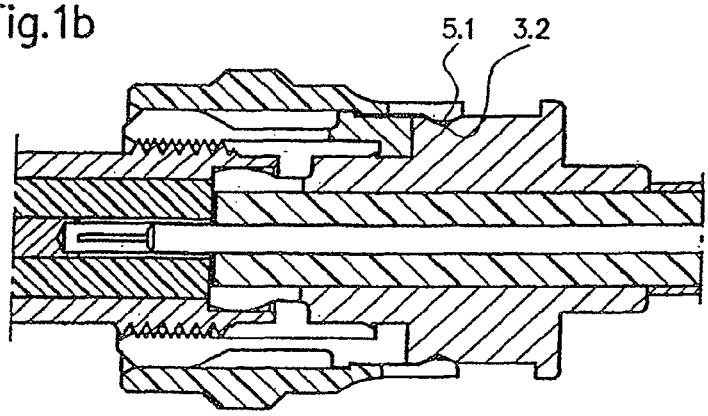
FIG. 1*b* depicts the sliding sleeve displaced to the locking position.

If the sliding sleeve 5 is displaced to the locking position shown in FIG. 1*b*, the collet 4 is compressed radially by this means and comes to bear, by a portion 4.1 having an inside thread, against the outside thread 2.1 on the coupler 2. If the threads 4.1 and 2.1 are of different pitches, it is ensured that the fixing concerned will take place regardless of the positions of the turns of thread relative to one another. When the sliding sleeve 5 is in the coupled position, an annular internal shoulder 5.1 at the end adjacent the cable of the sliding sleeve 5 engages in a complementary annular groove 3.2 in the male head 3. The internal shoulder 5.1 latches in the annular groove 3.2 in a way which can be felt, which indicates that the plug-in connection is locked. Any unintentional release of the plug-in connection is also prevented in this way. The sliding sleeve 5 is slotted at the end adjacent the cable, as a result of which the end of the sliding sleeve adjacent the cable is divided into strip-like segments 5.2 which are able to open radially in a resilient way (see FIG. 1).

Figure 2:
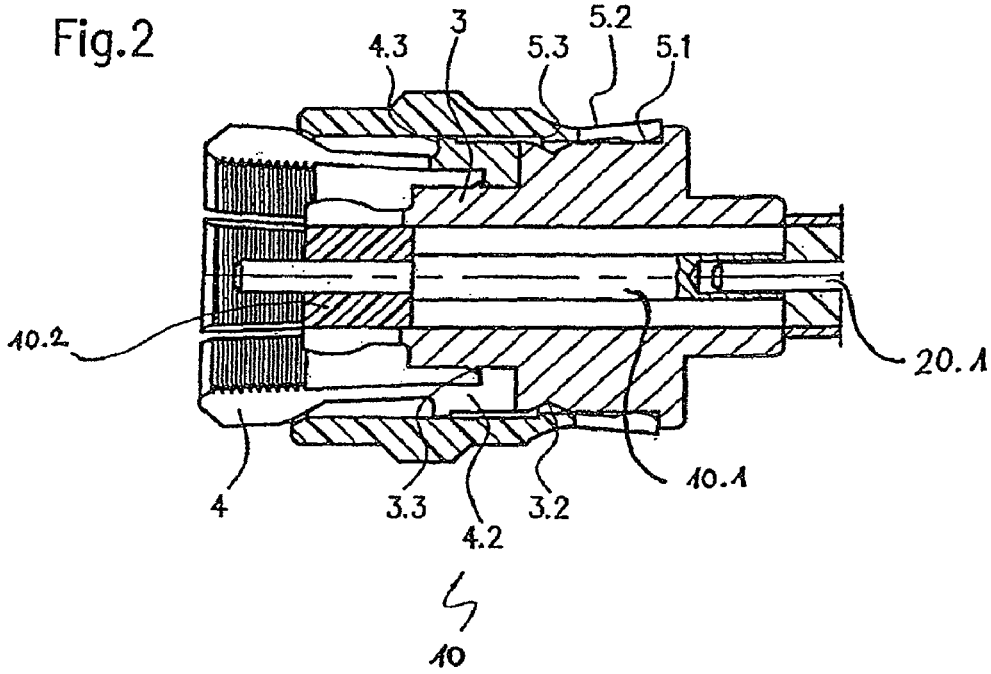
FIG. 2 depicts the collet and the sliding sleeve fitted by being slid onto the male head axially.

FIG. 2 shows that the collet 4 and the sliding sleeve 5 can be fitted by being slid onto the male head 3 axially. For this purpose, the collet 4 is continuously slotted at a point 4.2, thus enabling it to be slid over a small collar 3.3 on the male head. The collet also has an outer collar 4.3 which, in conjunction with an inside collar 5.3 in the sliding sleeve 5, acts as a means of securing the parts against being lost. To this extent, the plug-in connector 10 which is shown matches the plug-in connector 1 in FIGS. 1, 1*a* and 1*b*. The only thing that is different is that the plug-in connector 10 has, as is known per se, a centre conductor 10.1 of its own and a dielectric 10.2 of its own. Contact between the centre conductor 20.1 of the cable and the centre conductor of the plug-in connector is made by means of a pin-and-receptacle connection.

The invention claimed is:

1. An RF plug-in connector comprising:

a male head formed to receive an end of a coaxial cable having a center conductor and a dielectric, which is so arranged as to fit with said coaxial connector so that said center conductor of said coaxial cable forms said connector's center conductor, and said dielectric of said coaxial cable forms at least a portion of said connector's dielectric;

a sliding sleeve mounted on said male head, rotatable and axially displaceable therewith, and fitting over a collet, wherein said sliding sleeve includes an internal shoulder which, in a coupled position, engages in a recess in the circumferential surface of said male head, said sliding sleeve being slotted axially in the region of said shoulder;

said collet radially elastic and non-displaceably mounted on said male head in such a way as to allow rotation, and in such a way that in a coupled state, said sliding sleeve radially compresses said collet, said collet including an inserting end for insertion with a complementary coupler, said inserting end including an inside thread having a pitch that provides for a connection with an outside thread on said complementary coupler.

2. The RF plug-in connector of claim 1, wherein said sliding sleeve comprises a plastics material.

3. The RF plug-in connector of claim 1 including having said inside thread pitch differ from said outside thread of said complementary coupler to provide for said connection.

* * * * *